United States Patent [19]

Porter

[11] 4,392,704

[45] Jul. 12, 1983

[54] LOW INSERTION FORCE PRINTED CIRCUIT CARD CONNECTOR

[75] Inventor: Warren W. Porter, Escondido, Calif.

[73] Assignee: NCR Corporation, Dayton, Ohio

[21] Appl. No.: 274,100

[22] Filed: Jun. 16, 1981

[51] Int. Cl.[3] ..... H01R 13/62

[52] U.S. Cl. ..... 339/75 MP; 339/176 MP

[58] Field of Search ..... 339/75 R, 75 M, 75 MP, 339/176 MP

[56] References Cited

U.S. PATENT DOCUMENTS

| | | | |
|---|---|---|---|
| 2,920,163 | 1/1960 | Johnson | 339/95 D |
| 3,107,961 | 10/1963 | Hahn et al. | 339/75 MP |
| 3,670,288 | 6/1972 | Evans | 339/176 MP |
| 4,054,347 | 10/1977 | Mouissie | 339/75 M |
| 4,118,094 | 10/1978 | Key | 339/75 MP |
| 4,189,199 | 2/1980 | Grau | 339/75 MP |

FOREIGN PATENT DOCUMENTS

| | | | |
|---|---|---|---|
| 2423266 | 12/1974 | Fed. Rep. of Germany | 339/75 MP |
| 4422981 | 9/1969 | Japan | 339/75 MP |
| 639056 | 12/1978 | U.S.S.R. | 339/75 MP |

*Primary Examiner*—Eugene F. Desmond
*Assistant Examiner*—Gary F. Paumen
*Attorney, Agent, or Firm*—J. T. Cavender; Stephen F. Jewett; Edward Dugas

[57] ABSTRACT

An edge connector wherein an insulated base defines an elongated opening and an insulated carrier is slidably mounted to the base. The carrier is provided with an elongated opening for receiving a printed circuit board. A series of conductors are pivotly coupled between the base and the carrier, such that each of the conductors pivots about one end when the carrier is slid with respect to the base. The length of the conductors is sufficient to come into contact with the edge contacts of the printed circuit board when the printed circuit board is received by the carrier and for transmitting a retaining force to the printed circuit board. A series of resilient pins mounted to the base and in contact with the pivot end of respective conductor of the series of conductors provides along with a spring both the retaining force and the contact force necessary for good electrical contact.

9 Claims, 5 Drawing Figures

LOW INSERTION FORCE PRINTED CIRCUIT CARD CONNECTOR

BACKGROUND OF THE INVENTION

This invention relates to an electrical connector and more particularly to a low insertion force connector having a contact arrangement that provides good electrical contact while eliminating the wiping action normally experienced with printed circuit card insertion.

In many systems and for a variety of reasons, many electronic elements, components, circuitry, and interconnections are presently mounted, deposited, printed, or otherwise formed on one or both sides of a printed circuit board or other suitable substrate. Electrical interconnections between connectors are generally made to a backpanel. That is, the connector is inserted onto one surface of a backpanel with the connector leads extending through the backpanel, the wires forming the interconnects are then wire-wrapped around the extended conductors. The printed circuit board is then inserted into the connector on the backpanel. The connectors generally include a housing or base which is bolted or otherwise affixed to the backpanel and the housing is formed with a longitudinal slot for receiving one edge of the printed circuit board. Connections between the connector conductors and the corresponding edge contacts on the printed circuit board are generally made by mechanically biasing the connector conductors into engagement with the edge contacts of the printed circuit board. The mechanical biasing force serves two purposes, the first being to provide solid electrical connections and the second being to provide a grip on the printed circuit board so as to hold the printed circuit board in the connector. The biasing force must be relatively high to ensure that good conductive contacts are made and maintained. The high biasing force in turn causes a high insertion force which becomes excessive when the number of connector conductors is large. Any friction force on the printed circuit board edge contacts, causes a rubbing which removes the surface material. Since the edge contacts are only a few thousandths of an inch thick and generally gold-plated, this rubbing action will remove the high quality conductance surface and invite poor electrical contact and/or corrosion.

One solution to the insertion problem is the mechanical actuating mechanism that removes the biasing force during the insertion and removal of the printed circuit board. Such a mechanism is more specifically shown in U.S. Pat. No. 4,189,199, entitled, Electrical Socket Connector Construction by T. G. Grau. In that patent there is disclosed an actuating mechanism which is activated by the insertion of an integrated circuit pack causing the connector conductors to move into contact with the pins of the integrated circuit pack.

In summary of the prior art, zero insertion connectors eliminate the rubbing action by physically displacing the connector contacts from the edge contacts during insertion and removal of the printed circuit board.

The inventor of the present invention, Warren W. Porter, conceived of a low insertion force connector which is shown in U.S. Pat. No. 4,355,856, entitled Low Insertion Force Connector Using Non-Noble Metal Contact Plating, issued on Oct. 26, 1982. The connector of the referenced application utilizes electrically conductive pins which engage a printed circuit board as it is inserted into the connector. The engagement occurs at one end of the electrically conductive pins such that the point of contact with the circuit board is maintained and the electrical contact pin is rotated so as to follow the path of the printed circuit board into the connector. A biasing means pressing onto the opposite end of the electrically conductive pins maintains the pins in electrical contact with the edge contacts of the printed circuit board. Rubbing between the card contacts and connector conductors is thus eliminated. The connector of the referenced application is concerned with a printed circuit board having electrical contacts only on one end and wherein the board is inserted transverse to the longitudinal axis of the connector.

SUMMARY OF THE INVENTION

The preferred embodiment of the present invention is directed to a low insertion force connector of the type wherein the printed circuit board is entered through the end of the connector and slid into position by traversing the length of the connector. Generally, in end entry connector configurations, pairs of connectors are positioned to receive opposite ends of a printed circuit board. The circuit board is slid into the pair of connectors in a manner similar to a drawer sliding into a desk. The connectors are formed with an insulated base having an elongated opening. A carrier is slidably mounted in the elongated opening of the insulated base. A slot for receiving the printed circuit is formed in the carrier. A series of conductors are operatively coupled between the insulated base and carrier such that each of the conductors pivots about one end when the carrier is slid with respect to the insulated base. The length of the conductors is sufficient to cause a contact with the edge contacts of the printed circuit board when the printed circuit board is received by the carrier. The series of conductors also transmit a retaining force to the printed circuit board and the carrier. A series of resilient pins mounted to the insulated base and in contact with the pivot end of the conductors provides the retaining force to the series of conductors. A biasing means maintains the conductor carrier in an unloaded position prior to the insertion of the printed circuit board. In the unloaded position the series of conductors are retracted from the area designed to receive the printed circuit board. With the insertion of the printed circuit board into the carrier, further movement of the carrier overcomes the biasing means causing the series of conductors to extend into the cavity area occupied by the printed circuit board and to contact the edge contacts of the printed circuit board and to maintain that contact until the circuit board is removed. The resilient force of the series of resilient pins along with the biasing means maintains the printed circuit board in the inserted position until withdrawn.

From the foregoing it can be seen that it is a primary object of the present invention to provide an electrical connector having a low insertion force.

It is another object of the present invention to provide a low insertion force electrical connector of the edge entry type.

These and other objects of the present invention will become more apparent when taken in conjunction with the following description, and attached drawings, wherein like characters indicate like parts and which drawings form a part of the present application.

DESCRIPTION OF THE PREFERRED EMBODIMENTS OF THE INVENTION

Figure 1:
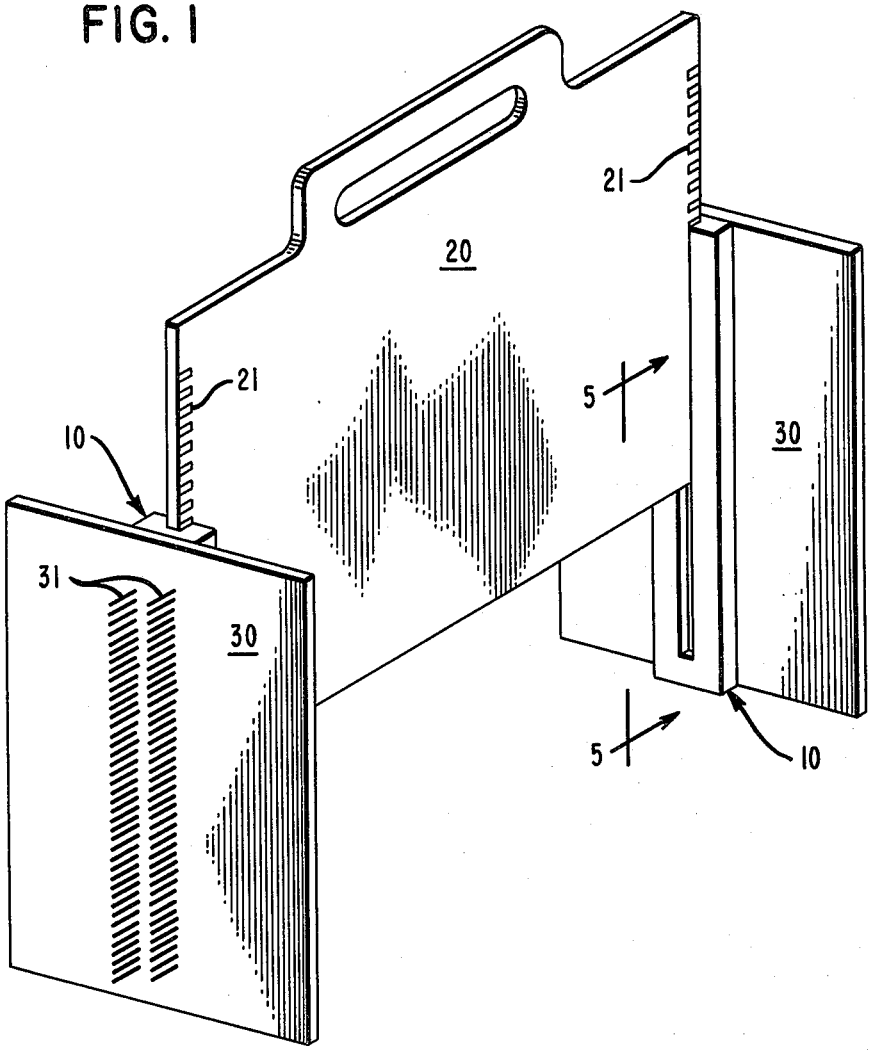
FIG. 1 is a perspective view showing the positioning of the electrical connectors of the present invention with regard to a printed circuit board and a pair of backpanels.

Referring to FIG. 1 wherein a pair of connectors 10 are shown affixed to a pair of backpanels 30 spaced apart a distance to receive a dual edge printed circuit board 20. The printed circuit board 20 has a plurality of edge contacts 21 positioned on each end and each side thereof. Corresponding in number and positioning to the edge contacts on the printed circuit board are a corresponding number of resilient pins 31 which pass through the backpanels 30 and into the body of the connector 10. The resilient pins 31 are generally press fitted into the backpanel 30. The remaining portion of the connector 10 is affixed to the backpanel by various suitable means. As can be gleaned from the Figure, the printed circuit board 20 is designed to be inserted into the connectors 10 by a downward force and to be removed by an upward force. It will be obvious that the connectors and backpanels could be mounted in a horizontal position with the same operation.

Figure 2:
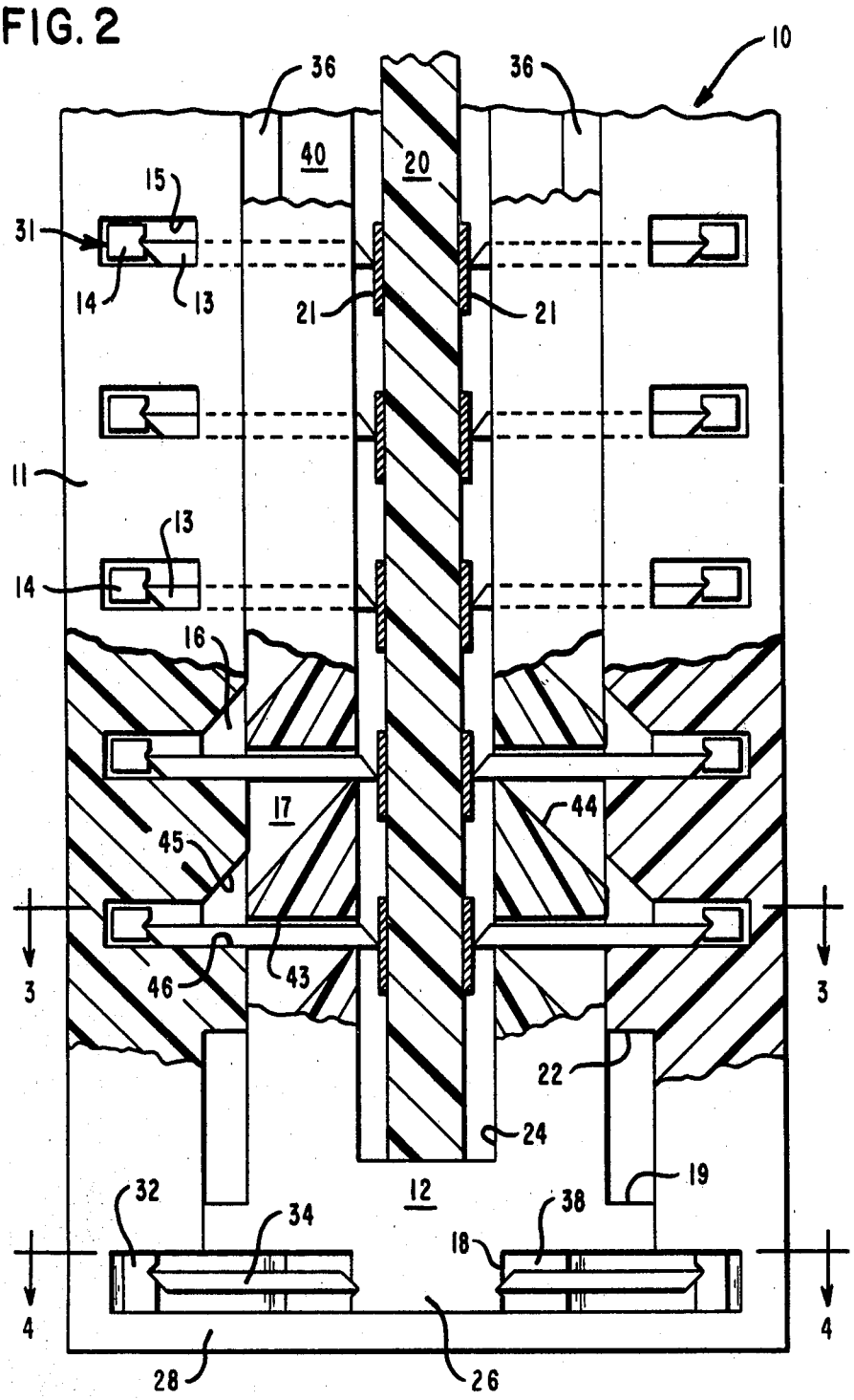
FIG. 2 is a partially cutaway view of the inventive connector of the present invention with the printed circuit board inserted.
Figure 3:
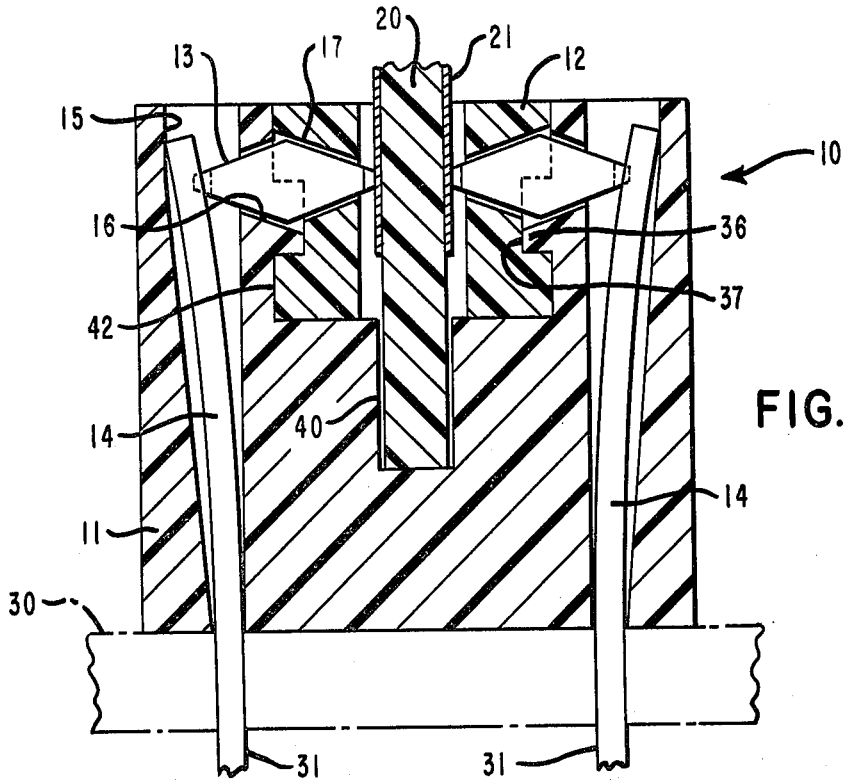
FIG. 3 is a section view taken along the section lines A—A in FIG. 2.

Referring now to FIGS. 2 and 3, the connector 10 has an insulating base 11 defining an elongated opening 40 for accepting the edge of a printed circuit board 20. A larger elongated opening 42 having inward projecting track sections 36 positioned on each side of the elongated opening 40 is designed to slidably receive an insulated carrier 12. The carrier 12 contains recessed sections 37 corresponding to the tracks 36 so as to enable the carrier 12 to slide along the insulating base 11. Resilient electrical pins 31 extend through the backpanel 30 and into the insulating base 11. Openings 15 in the base 11 permit the ends 14 of the pins 31 to traverse a path substantially perpendicular to their length. A series of floating conductors 13, having a trapezoidal shape, connect at one end to an associated pin and at the other end to an associated electrical edge contact 21 on the printed circuit board. Trapezoidal shaped openings 16 and 17 formed in the insulated base 11 and the carrier 12, respectively, allow the floating conductors 13 a limited freedom of motion. The openings 16 and 17 define a series of individual passageways. The opening 17 is bounded by an inclined surface 44 and a relatively flat surface 43 formed as part of the carrier 12. The opening 16 is bounded by an inclined surface 45 and a relatively flat surface 46. When the carrier is bottomed (loaded), the flat surface 43 provides an upward limit for the floating conductor 13 positioned adjacent its surface. In a like manner, surface 46, in opening 16, provides a downward limit to conductor 13. When the circuit board is removed and carrier 12 is in an unloaded position, surface 44 provides a down limit for the floating conductor 13 positioned just above. This can be more clearly seen in FIG. 5. In a like manner, the surface 45 of opening 16 limits the upward travel of conductor 13. The carrier is limited in its travel within the insulated base 11, in one direction by projecting surfaces 19 on the carrier and 22 on the insulated base. In the loaded position, a projection 26 on the end of the carrier 12 abuts an end surface 28 of the insulated base 11. The ideal end is a small sphere.

Various means may be utilized for biasing the connector body 12 in the unloaded and the loaded position. One such means is shown comprised of a U-shaped spring 32 and pivot arms 34. The pivot arms engage the arms and the surface of projection 26 of the spring 32. In the position shown, the force exerted by the spring 32 acting through pivot arms 34 provide a bottoming force that is downward on the drawing face so as to force the projection 26 into an abutting relationship with the end surface 28.

Figure 4:
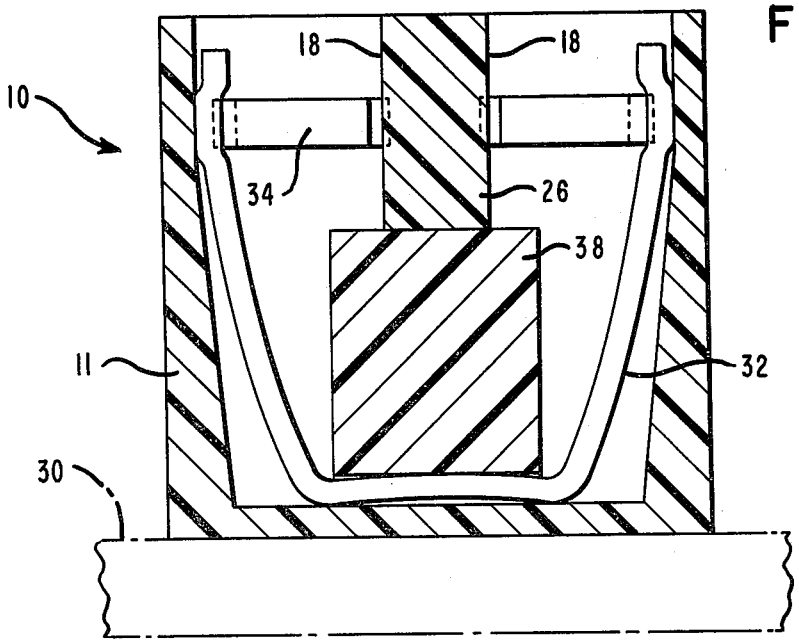
FIG. 4 is a section view taken along the section lines B—B in FIG. 2.

Referring now to FIG. 4, where the biasing element is shown in further detail, the base 11 is recessed to form an island center 38, the recess is designed to accept the U-shaped spring 32. The pivot arms 34 are shown pressed by the arms of the spring 32 onto the surfaces 18 of the carrier projection 26. Other biasing means may be utilized in the present invention without detracting from the point of novelty.

Figure 5:
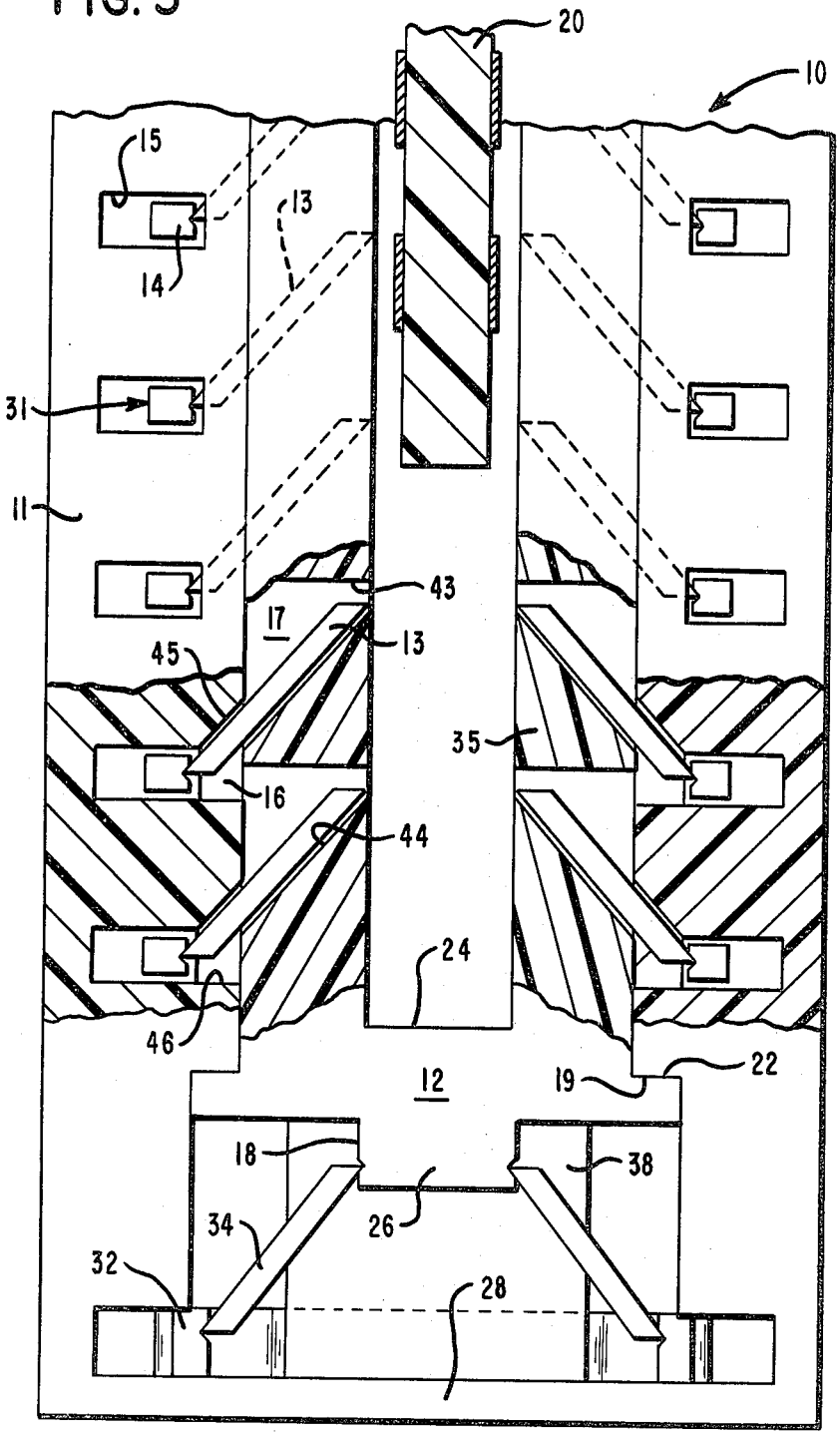
FIG. 5 is a partial section view similar to that of FIG. 1 with the printed circuit board removed.

Referring now to FIG. 5, which shows the connector in its static state with the printed circuit board removed. In this position, the resilient pins 31 and the U-shaped spring 32 have urged the carrier 12 into its uppermost (unloaded) position such that the projecting surfaces 19 and 22 are abutting each other and such that the floating conductors 13 are retracted from the opening 24 in the carrier member 12. As can be seen from the drawings, the printed circuit board, when in the process of insertion, will fit into the opening 24 with a fair amount of clearance and without any contact with conductors 13. When the printed circuit board abuts against the bottom surface of the carrier 12, the carrier 12 commences to slide to a loaded position and the conductors 13 extend into the open area 24 so as to engage the edge contacts 21 on the printed circuit board. Further insertion pressure causes the overtravel (past an equilibrium point) of the conductors 13 so that the resilient force from pins 31 and spring 32 force and hold the printed circuit board into position with a positive electrical contact.

While there has been shown what is considered to be the preferred embodiment of the invention, it will be manifest that many changes and modifications can be made therein without departing from the spirit and scope of the invention, the scope of the invention being limited only by the terms of the appended claims.

I claim:

1. A printed circuit board connector comprising:

an insulated base defining an elongated opening;

an insulated carrier slidably mounted to said insulated base in said elongated opening and adapted to receive the edge of a printed circuit board;

a series of conductors operatively coupled between said insulated base and said carrier such that each of said conductors pivots about one end when said carrier is slid with respect to said insulated base, the length of said conductors being sufficient to come into contact with the edge contacts of the printed circuit board when the printed circuit board is received by said carrier and for transmitting a retaining force to said printed circuit board and to said carrier;

a series of resilient pins mounted to said insulated base and in contact with the pivot end of a respective conductor of said series of conductors to provide the retaining force to said series of conductors; and biasing means connected between said insulated base and said insulated carrier for sliding said carrier to an unloaded position when the printed circuit board is removed, and for maintaining said carrier in a loaded position when the printed circuit board is inserted in said connector.

2. The printed circuit board connector according to claim 1 wherein said insulated base and said insulated carrier each have a series of passageways for accepting and retaining a corresponding conductor of said series of conductors such that said conductors will project from said passageway as the insulated carrier is slid into said insulated base.

3. The printed circuit board connector according to claim 1 wherein said biasing means is comprised of:

a U-shaped spring affixed in said insulated base member with the arms of said U-shaped spring straddling one end of said insulated carrier; and pivot arms operatively connected between the arms of said U-shaped spring and said insulated carrier for urging said carrier to slide in a first direction if the arms are past an equilibrium point in one direction or to slide in a second direction if the arms are past an equilibrium point in another direction.

4. A printed circuit board connector of the end entry type comprising:

an insulated base defining an elongated opening;

a series of resilient pins mounted in said insulated base and deflectable at one end within said insulated base, said series of pins positioned along said elongated opening;

a carrier slidably mounted to said insulated base within said defined elongated opening, said carrier defining a slot for receiving the edge portion of a printed circuit board;

a series of individual passageways through said insulated base and said carrier, one end of each said passageways connecting to a corresponding one of said resilient pins, the other end of said passageways corresponding to an associated edge connector on a printed circuit board; and a series of floating conductors, one each positioned in a passageway with one end of each conductor connectable to an associated resilient pin and the other end connectable to a respective edge contact on a printed circuit board when the printed circuit board is inserted in said carrier and said carrier is slid into said insulated base; and biasing means connected between said insulated base and said carrier for sliding said carrier to an unloaded position when the printed circuit board is removed, and for maintaining said carrier in a loaded position when the printed circuit board is inserted in said connector.

5. The printed circuit board connector according to claim 4 wherein each of said floating conductors is of a length sufficient to deflect said resilient pins when said floating conductors are in contact with the edge contacts on the printed circuit board so as to generate contact pressure between the conductors.

6. The printed circuit board connector according to claim 4 wherein each of said passageways is configured to cause said floating conductors to pivot at one end when said carrier is slid in said insulated base.

7. The printed circuit board connector according to claim 4 wherein each of said floating conductors is pointed at each end to insure electrical contact with said resilient pins and with the edge contacts on the printed circuit board.

8. The printed circuit board connector according to claim 4 wherein each of said floating conductors is trapezoidal in shape and wherein said passageways are also trapezoidal in shape so as to limit the movement of said floating conductors.

9. The printed circuit board connector according to claim 4 wherein said biasing means is comprised of:

a U-shaped spring affixed in said insulated base member with the arms of said U-shaped spring straddling one end of said carrier; and pivot arms operatively connected between the arms of said U-shaped spring and said carrier for urging said carrier to slide in a first direction if the arms are past an equilibrium point one direction or to slide in a second direction if the arms are past an equilibrium point in another direction.

* * * * *